US006242148B1

(12) United States Patent
Nakajima

(10) Patent No.: US 6,242,148 B1
(45) Date of Patent: Jun. 5, 2001

(54) DEVELOPING AGENT, IMAGE FORMING APPARATUS, AND METHOD FOR FORMING IMAGE

(75) Inventor: Takahiro Nakajima, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,891

(22) Filed: Feb. 23, 2000

(51) Int. Cl.[7] ..... G03G 9/097; G03G 13/20; G03G 15/20

(52) U.S. Cl. ..... 430/110; 430/111; 430/124; 399/320

(58) Field of Search ..... 430/110, 111, 430/124; 399/320

(56) References Cited

U.S. PATENT DOCUMENTS 5,176,978 * 1/1993 Kumashiro et al. ..... 430/110
5,612,160 * 3/1997 Inoue et al. ..... 430/124
5,814,428 * 9/1998 Kido et al. ..... 430/111
5,824,446 * 10/1998 Nishihara et al. ..... 430/111
5,866,291 * 2/1999 Ikegami et al. ..... 430/110
5,948,583 * 9/1999 Silence et al. ..... 430/110

FOREIGN PATENT DOCUMENTS 1-134385 5/1989 (JP) .
7-181821 7/1995 (JP) .

* cited by examiner

*Primary Examiner*—Roland Martin
(74) *Attorney, Agent, or Firm*—Foley & Lardner

(57) ABSTRACT

The present invention uses a toner containing a styrene-acrylic resin having a glass transition point between 50 and 65° C. and a 150° C. melt index between 1 and 10 (g/10 min.), a polyethylene wax in 1 to 3% by weight. of the total weight of the toner, which wax has a melting point between 90 and 128° C., and a polypropylene wax in 3 to 6% by weight. of the total weight of the toner, which wax has a melting point between 135 and 146° C.

17 Claims, 2 Drawing Sheets

DEVELOPING AGENT, IMAGE FORMING APPARATUS, AND METHOD FOR FORMING IMAGE

BACKGROUND OF THE INVENTION

The present invention relates to an image forming apparatus such as an electrophotographic apparatus or a static recording apparatus, a method for forming images using this apparatus, and a developing agent for use in this apparatus.

An electrophotographic apparatus or a static recording apparatus forms an image by using a photoreceptor or a derivative to form an electrostatic latent image on an image carrier, using a toner to develop and visualize the electrostatic latent image, transferring the obtained toner image to an image receiving member, and then fixing the image. Conventionally known fixing techniques include the heating fixing method, the pressure fixing method, the high-frequency heat fixing method, the electromagnetic induction heating method, and the combined fixing method that is a combination of the flush fixing method and the electromagnetic induction heating method.

In particular, the electromagnetic induction heating method is known as a technique capable of reducing the size of the apparatus, the warm-up time, and the amount of energy required. This technique installs an exciting coil in pressure means and carries out heating using, as a heat source, Joule heat generated by applying high-frequency magnetic fields to a magnetized metallic surface of heating means provided opposite to the pressure means.

The electromagnetic induction heating method, however, is disadvantageous in that the temperature distribution on the surface of the heating means may not be uniform. For example, a phenomenon may occur in which part of the heating means surface which corresponds to a width-wise central portion of the image receiving member is hot, while parts of the heating means surface which correspond to opposite ends thereof are cool. In this case, images of a stable image density cannot be obtained. In addition, parts of the heating means surface by which the image receiving member has passed may is cooled because the heat transfers to the material, while parts thereof by which the material has not passed become hotter than required, resulting in offsets in the end portion of the material.

BRIEF SUMMARY OF THE INVENTION

The present invention is provided in view of the above conventional problem, and it is a first object thereof to provide a developing agent that serves to reduce the size of the apparatus, the warm-up time, and the amount of energy required and that provides excellent images of a stable image density without an offset when applied to a heating means that is likely to cause a non-uniform temperature.

In addition, it is a second object of the present invention to provide a small image forming apparatus that reduces the warm-up time and the amount of energy required and that provides excellent images of a stable image density without an offset.

Further, it is a third object of the present invention to provide an image forming method that can reduce the size of the apparatus used, the warm-up time, and the amount of energy required and that provides excellent images of a stable image density without an offset.

First, the present invention provides a developing agent comprising:

a coloring agent and a toner containing a styrene-acrylic resin having a glass transition point between 50 and 65° C. and a 150° C. melt index between 1 and 10 (g/10 min.);

a polyethylene wax in 1 to 3% by weight. of the total weight of the toner, the polyethylene wax having a melting point between 90 and 128° C.; and a polypropylene wax in 3 to 6% by weight. of the total weight of the toner, the polypropylene wax having a melting point between 135 and 146° C.

Second, the present invention provides an image forming apparatus comprising:

an image carrier;

a developing device provided opposite to the image carrier for housing a developing agent comprising:

a coloring agent and a toner containing a styrene-acrylic resin having a glass transition point between 50 and 65° C. and a 150° C. melt index between 1 and 10 (g/10 min.), a polyethylene wax in 1 to 3% by weight. of the total weight of the toner, the polyethylene wax having a melting point between 90 and 128° C., and a polypropylene wax in 3 to 6% by weight. of the total weight of the toner, the polypropylene wax having a melting point between 135 and 146° C., and for developing an electrostatic latent image formed on the image carrier in order to form a developing agent image;

a transfer device for transferring the developing agent image onto an image receiving member; and a fixing device based on the electromagnetic induction heating method for fixing the developing agent image transferred onto the image receiving member.

Third, the present invention provides an image forming method comprising:

the electrostatic latent image formation step of forming an electrostatic latent image on an image carrier;

the developing step of developing the electrostatic latent image using a developing agent comprising a coloring agent and a toner containing a styrene-acrylic resin having a glass transition point between 50 and 65° C. and a 150° C. melt index between 1 and 10 (g/10 min.), a polyethylene wax in 1 to 3% by weight. of the total weight of the toner, the polyethylene wax having a melting point between 90 and 128° C., and a polypropylene wax in 3 to 6% by weight. of the total weight of the toner, the polypropylene wax having a melting point between 135 and 146° C.;

the transfer step of transferring the developed developing agent image onto an image receiving member; and the fixing step of fixing the developing agent image transferred onto the image receiving member, by heating the image based on the electromagnetic induction heating method while pressurizing the image.

According to the present invention, the non-uniform temperature distribution on the surface of the heating member, which is a disadvantage of the electromagnetic induction heating method, can be avoided by combining the styrene-acrylic resin of a high viscosity with the polyethylene and polypropylene waxes of low melting points to widen a non-offset area.

DETAILED DESCRIPTION OF THE INVENTION

Figure 1:
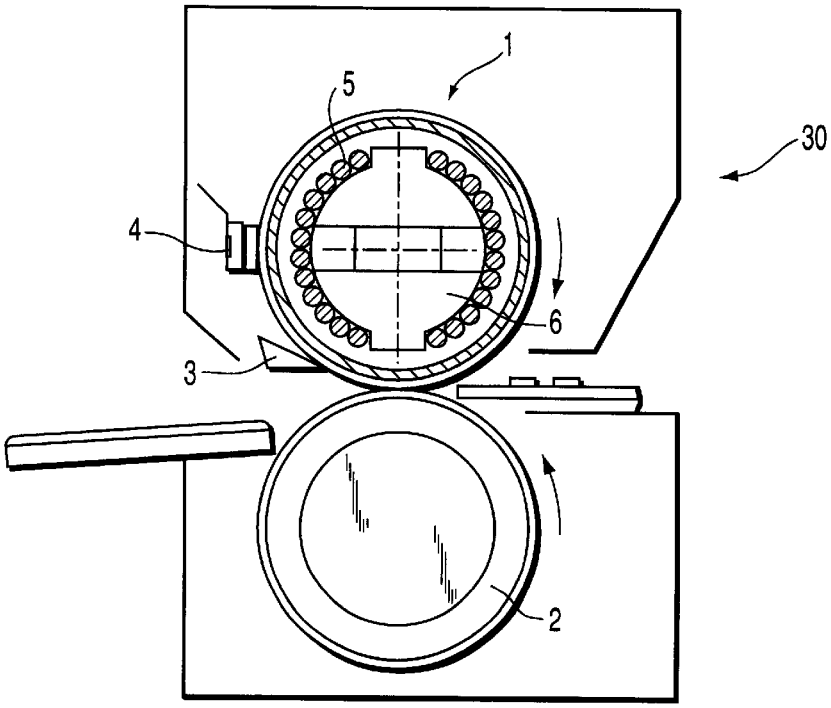
FIG. 1 is a schematic drawing showing an example of a fixing device for use in an image forming apparatus according to the present invention.

A developing agent according to the present invention comprises a coloring agent and a toner containing a binder resin, and the binder resin used contains a styrene-acrylic resin having a glass transition point between 50 and 65° C. and a 150° C. melt index between 1 and 10 (g/10 min.), a polyethylene wax in 1 to 3% by weight. of the total weight of the toner, which wax has a melting point between 90 and 128° C., and a polypropylene wax in 3 to 6% by weight. of the total weight of the toner, which wax has a melting point between 135 and 146° C.

In addition, an image forming apparatus according to the present invention utilizes a combination of the developing agent and the electromagnetic induction heating method, and comprises an image carrier;

- a developing device provided opposite to the image carrier for housing the above developing agent and developing an electrostatic latent image formed on the image carrier in order to form a developing agent image;
- a transfer device for transferring the obtained developing agent image onto an image receiving member; and
- a fixing device based on the electromagnetic induction heating method for fixing the developing agent image transferred onto the image receiving member.

The fixing device, which includes heating means based on the electromagnetic induction heating method, has, for example, a heating member and a pressure member. The heating member has a magnetized metallic surface. At least one of the heating and pressure members has an exciting coil built thereinto and connected to means for generating high-frequency magnetic fields.

Further, an image forming method according to the present invention uses the above image forming apparatus to form a image, and comprises:

- the electrostatic latent image formation step of forming an electrostatic latent image on an image carrier;
- the developing step of developing the electrostatic latent image using the above developing agent;
- the transfer step of transferring the developed developing agent image onto an image receiving member; and
- the fixing step of fixing the developing agent image transferred onto the image receiving member, by heating the image based on the electromagnetic induction heating method while pressurizing the image.

The fixing step is carried out by, for example, bringing a heating member having a magnetized metallic surface into pressure contact with a pressure member located opposite to the heating member via the image receiving member, which has a transferred developing agent image, applying high-frequency magnetic fields to the magnetized metallic surface to generate Joule heat from the magnetized metallic surface in order to fix the developing agent image to the image receiving member.

The present invention eliminates the disadvantage of the electromagnetic induction heating method, that is the non-uniform temperature distribution; excellent images can be obtained without an offset using the toner having a wide non-offset area.

First, the viscosity of the toner can be reduced by addition of polyethylene wax having a low melting point. The decrease in toner viscosity provides good results; fixation can be achieved at low temperature while offsets are prevented from occurring at low temperature.

In addition, the use of the polyethylene wax is effective in improving the smear characteristic due to its highly crystal structure. The use of the polyethylene wax alone, however, degrades the offset characteristic, so that it must be used with the polypropylene wax.

Further, the use of a binder resin of a relatively high viscosity prevents offsets from occurring at low temperature.

According to the present invention, the use of the polyethylene and polypropylene waxes having relatively low melting points and of the binder resin of a high viscosity can widen the non-offset area to prevent smears in the image after fixation even with omission of a cleaner mechanism for the fixing device. This configuration also enables the use of a fixing system based on the electromagnetic induction heating method, which can reduce the warm-up time, thereby reducing the amount of energy required and the size of the apparatus.

The binder resin used for the present invention preferably has a glass transition point between 55 and 61° C. When the glass transition point is above 61° C., a fixing ratio tends to decrease, and below 55° C., it tends to cause blocking phenomenon under condition of high temperature and high humidity. The binder resin preferably has a 150° C. melt index between 3 and 8 g/10 min. When the 150° C. melt index exceeds 8 g/10 min, high temperature-offset tends to occur, and when it is less than 3 g/10 min, the fixing ratio tends to decrease.

The polyethylene wax has a preferable melting point between 90 and 116° C. When the melting point is above 116° C., the viscosity of the toner tends to increase to make the fixing ratio be decreased, and below 90° C., it tends to decrease to generate high temperature-off. The polyethylene wax has a preferable addition amount between 1 and 3% by weight. of the total weight of the toner. When the addition amount exceeds 3% by weight., the viscosity of the toner tends to decrease to generate high temperature-offset, and when it is less than 1% by weight., it tends to increase to make the fixing ratio be decreased and deteriorate smear properties.

The polypropylene wax has a preferable melting point between 135 and 146° C. When the melting point is above 146° C., the viscosity of the toner tends to increase to make the fixing ratio be decreased, and below 135° C., it tends to decrease to generate high temperature-offset. The polypropylene wax has a preferable addition amount between 4 and 6% by weight. of the total weight of the toner. When the addition amount exceeds 6% by weight., the flowability of the toner tends to decrease cause blocking phenomenon under condition of high temperature and high humidity, and when it is less than 4% by weight., high temperature offset tends to occur.

FIG. 1 shows an example of a fixing device for use in an image forming apparatus according to the present invention.

This fixing device 30 comprises a heating roller 1 and a pressure roller 2. The pressure roller 2 can be brought into pressure contact with the heating roller 1 using a pressure mechanism. The pressure contact of the pressure roller 2 is maintained in such a manner as to set a fixed nip width. The heating roller 1 can be driven by a drive motor in the direction of the arrow in the figure. The pressure roller 2 is adapted to rotate in the arrow direction in a fashion following the heating roller 1.

The heating roller 1 consists, for example, of iron and has a thickness of about 1 mm. The surface of the roller is coated with a parting layer such as Teflon. Other roller materials include stainless steel, aluminum, and composite materials thereof.

The pressure roller 2 is composed, for example, of a mandrel around which a silicon or fluorine rubber is coated.

When an image receiving member such as paper passes through a pressure contact portion between the heating roller 1 and the pressure roller 2, that is, a nip portion, a toner on the paper is melted and brought into pressure contact with the paper for fixing. The heating roller 1 has a releasing claw 3 and a thermistor 4 provided thereon downstream of the contact position between the heating roller 1 and the pressure roller 2 in a rotating direction, the releasing claw 3 releasing copy paper from the heating roller 1, the thermistor 4 detecting the temperature of the heating roller 1.

An electromagnetic induction heating device is comprised of an exciting coil 5 located on an inner periphery of the heating roller 1. The exciting coil 5 comprises 0.5-mm linear copper wire rods; these plurality of insulated wire rods are bundled into a litz wire. The formation into the litz wire results in a wire diameter smaller than the penetration depth, thereby enabling alternating current to flow through the wire effectively. For example, the illustrated apparatus has 16 0.5-mm copper wire rods bundled together. Covered wires for the coil covered with a heat-resisting polyamide. A magnetic-field generation means comprises a blank core coil instead of a core material such as a ferrite or an iron core in order to concentrate magnetic fluxes from the coil. The coil is supported by a coil support 6 formed of a heat-resisting resin material, for example, heat-resisting engineering plastics. The coil support 6 is positioned between sheet metals (not shown) holding the roller.

Magnetic fluxes generated by a high-frequency current applied to the exciting coil 5 by an exciting circuit (inverter circuit; not shown) yield magnetic fluxes and an eddy current on the heating roller 1 in such a manner as to prevent variations in magnetic fields. This eddy current and the resistance of the heating roller, which is made of iron, generate Joule heat to heat the heating roller 1. For example, a high-frequency current of frequency 25 kHz and output 900 W is allowed to flow through the excitation coil. The surface temperature of the pressure roller is set at 180° C. and can be controlled. The surface temperature is detected by the thermistor so that the heating roller 1 is heated based on feedback control. Fixing a toner requires the temperature of the entire roller (in its circumferential direction) to be uniform. If both rollers are stopped, magnetic fluxes have different intensities in the circumferential direction due to the characteristics of the blank core coil, leading to a non-uniform temperature distribution.

Thus, during operation, the temperature in the circumferential direction must be made uniform before the toner reaches the nip portion. Accordingly, although the heating and pressure rollers 1 and 2 are stopped for a fixed amount of time, these rollers are subsequently rotated in order to make the temperature distribution of the entire rollers uniform. Rotating the rollers allows the overall surfaces of the rollers to receive a fixed amount of heat. The heating roller surface temperature requires about 30 seconds to reach 1,800° C., at which a copying operation is enabled. On passing through the nip portion between the heating roller 1 and the pressure roller 2, the toner on the paper is melted and brought into pressure contact with the paper for fixation.

Figure 2:
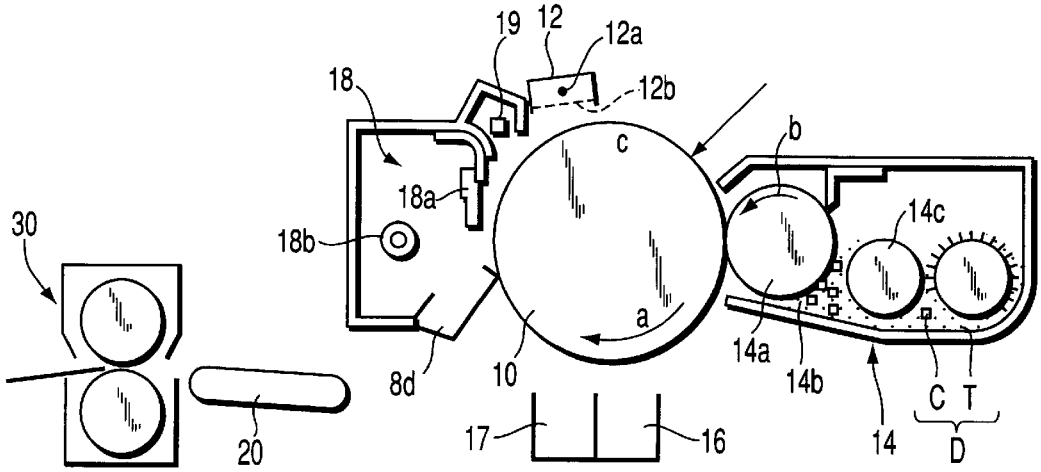
FIG. 2 is a schematic drawing showing an example of an image forming apparatus according to the present invention.

FIG. 2 shows a schematic drawing illustrating an example of an image forming apparatus according to the present invention.

This image forming apparatus has a photoreceptor drum 10 that can be rotated in the direction of an arrow a by a main motor (not shown). Using a laser beam from a separately provided laser exposure apparatus, an electrostatic latent image corresponding to image information to be recorded can be formed on the surface of the photoreceptor drum 10. There are provided around the photoreceptor drum 10, a charging device 12 for charging the photoreceptor drum 10 up to a predetermined potential along the rotating direction of the drum 10 indicated by the arrow a, a developing device 14 for forming an electrostatic latent image by supplying a toner to an electrostatic latent image formed on the photoreceptor drum 10 by the separately provided laser exposure apparatus, a transfer device for transferring to paper, the toner formed on the photoreceptor drum 10 by the developing device 14, a releasing device 17 for releasing the paper from the photoreceptor drum, a cleaning device for scraping off untransferred toner remaining on the surface of the photoreceptor drum 10, and a static elimination device 19 for eliminating charges remaining on the surface of the photoreceptor drum 10, wherein these devices are arranged in this order. In addition, the transfer device 16 and the releasing device 17 are provided with a fixing unit 30 via a conveying means 20.

In FIG. 2, the static eliminating device 19 is integrated with a housing of the cleaning device 18, but may be provided separately. In addition, a toner removing device may be provided between the cleaning device 18 and the transfer device 16 for facilitating the cleaning of an untransferred toner. Furthermore, a separate static elimination device may be provided between the developing device 14 and the transfer device 16 for facilitating the transfer of a toner onto paper. In addition, the cleaning device 18 can also be used as a drum holding body because it has a drum holding section for holding the photoreceptor drum 10 during loading in the image forming apparatus.

The charging device 12 includes a corona wire 12*a* and a grid screen 12*b* connected to a high-voltage circuit and a grid bias voltage generation device (neither of them shown) to charge the surface of the photoreceptor body drum 10 up to a predetermined surface potential.

The developing device 14 accommodates a developing agent D containing a toner T according to the present invention and magnetized carrier particles C coated with an insulating resin wherein the toner T and the magnetized carrier particles C are mixed together at a predetermined rate. The developing agent D can be used to form a magnetic brush on a developing agent carrier 14*a*, which is then brought into contact with the photoreceptor drum 10 located opposite to the developing agent carrier 14*a*, thereby developing and visualizing an electrostatic latent image on the photoreceptor drum 10. The developing agent D and a developing roller 14*a* are accommodated in a housing 14*b*. The developing roller 14*a* has a guide roller 14*c* located at opposite ends thereof in its longitudinal direction for maintaining a fixed distance between a non-magnetized developing roller surface forming an outer peripheral surface of the developing roller 14*a* and a photosensitive layer in the surface of the photoreceptor drum 10. To maintain the fixed distance, instead of the guide roller, materials of a fixed thickness may be provided by means of adhesion or coating or materials of a fixed thickness may be provided at the ends of the photoreceptor drum by means of adhesion or coating. This allows the distance between the surface of the developing roller 14*a* and the photosensitive layer of the photosensitive drum 10 to be constantly maintained at a fixed value.

The developing roller 14*a* has a magnet medium inside which has a plurality of fixed magnets with an S or N pole (not shown) arranged in a circumferential direction of the roller at predetermined angles.

A predetermined developing bias voltage is applied via a developing bias voltage generation circuit (not shown) to the developing roller 14*a* and to the developing agent D in the developing device 14 which contains the toner T and the magnetized carrier particles C.

Due to image force, the toner T adheres to heads of the magnetized carrier particles C formed on a sleeve, along magnetic force lines generated by a main electrode of the magnetic medium in the developing roller 14*a*. An electrostatic latent image formed on the surface of the photoreceptor drum 10 is developed when the toner T is moved in a developing area in which the photoreceptor drum 10 and the developing roller 14*a* are opposed to each other, because of electric fields formed by the potential of the electrostatic latent image on the photoreceptor drum 10 and by a developing bias potential.

The toner T transferred to paper by the transfer device 16 and releasing device 17 is conveyed by the conveying unit 20 such as a belt or roller to the fixing unit 30, which has a configuration similar to the apparatus shown in FIG. 1.

The toner for use in the image forming apparatus will be explained below in detail.

The developing agent according to the present invention uses a binder resin having a glass transition point between 50 and 65° C. and a 150° C. melt index between 1 and 10 (g/10 min.). The use of a binder resin having these ranges of resin characteristics allows the toner to be efficiently fixed to paper during a fixing step. Such a resin also has the effect of precluding the toner from being solidified during storage in a hot and humid environment.

The resin material available for the present invention includes a copolymer of a styrene and its substitution product or an acrylic-based resin.

The copolymer of a styrene and its substitution product includes, for example, a polystyrene homopolymer, a styrene resin with hydrogen addition, styrene-isobutylene copolymer, a styrene-butadiene copolymer, an acrylonitrile-butadiene-styrene three-component copolymer, an acrylonitrile-styrene-acrylic ester three-component copolymer, a styrene-acrylonitrile copolymer, an acrylonitrile-acrylic rubber-styrene three-component copolymer, an acrylonitrile-EVA-styrene three-component copolymer, a styrene-p-chlorostyrene copolymer, a styrene-propylene copolymer, a styrene-butadiene rubber, or a styrene-maleic anhydride.

In addition, the acrylic-based resin includes, for example, a polyacrylate, a polymethylmethacrylate, a polyethylmethacrylate, a poly-n-butylmethacrylate, a polyglycidylmethacrylate, polycondensed fluorine acrylate, a styrene-methacrylate copolymer, a styrene-butylmethacrylate copolymer, or a styrene-acrylic ethyl copolymer.

The other available binder resins include a polyvinyl chloride, a polyvinyl acetate, a polyethylene, a polypropylene, a polyester, a polyurethane, a polyamide, an epoxy resin, a phenol resin, a urea resin, a polyvinyl butyral, a polyacrylic resin, a rosin, a modified rosin, a terpen resin, an aliphatic or alicylic hydrocarbon resin, an aromatic petroleum resin, a chlorinated paraffin, and a paraffin wax, which are used in a unitary or mixed form.

A charge control agent available for the present invention includes an alloy azo dye, for example, "Bali First Black 3804", "Pontron S-31", "Pontron S-32", "Pontron S-32", "Pontron S-34", "Pontron S-36" (manufactured by Orient Chemical Co., Ltd.), "Aizen Spiron Black TRH", "T-95", "T-77" (manufactured by Hodogaya Chemical Co., Ltd.), an metal complex of an alkyl derivative of salicylate, for example, "Pontron E-82", "Pontron E-84", "Pontron E-85" (manufactured by Orient Chemical Co., Ltd.), and metal-free "TN-105" (manufactured by Hodogaya Co., Ltd.).

The coloring agent available for the present invention includes a carbon black or an organic or inorganic pigment or dye. The carbon black includes, but not limited to, a thermal black, an acetylene black, a channel black, a furnace black, a lamp black, or a ketchen black, for example.

The present invention uses polypropylene and polyethylene as a parting agent. The polypropylene wax has a melting point between 135 and 146° C. and is added in 3 to 6% by weight. The polyethylene wax has an addition amount between 90 and 180° C. and is added in 1 to 3% by weight.

The other available parting agents include waxes such as a carnauba wax, a rice wax, a stearate wax, a montan-based wax, a liquid paraffin, an acid amide, a sazole wax, a caster wax, and a chlorinated paraffin.

An additive that can be added to the toner according to the present invention includes silica grains, metallic oxide grains, and cleaning auxiliaries. The silica grains include a silicon dioxide, an aluminum silicate, a sodium silicate, a zinc silicate, and a magnesium silicate.

The metallic oxide grains include an zinc oxide, a titanium oxide, an aluminum oxide, an zirconium oxide, a strontium titanate, and a barium titanate. The cleaning auxiliaries include resin powders such as a polymethylmethacrylate, a polyvinylidene fluoride, and a polytetrafluoroethylene. These external additives may be subjected to surface treatment such as hydrophobicity treatment.

A method for manufacturing the toner according to the present invention will be described below.

First, the binder resin, the coloring agent, the waxes, the charge control agent, and other components as required are dispersed and mixed together using a ball mill, a V-blender, a Nauta mixer, or a Henshel mixer.

Next, the mixture obtained is melted and kneaded under heat using a pressure kneader, a roll, a screw extruder, or a banbury mixer. Subsequently, the kneaded mixture is coarsely crushed using a hammer mill, a crusher mill, or a jet mill. Further, the coarsely crushed mixture is pulverized using the jet mill, and the resulting mixture is then classified into desired particle sizes by means of air separation or the like.

Finally, a predetermined additive is added to the mixture and mixed therewith using a high-speed fluidized blender to obtain a desired toner. This high-speed fluidized blender includes, for example, a Henshel mixer, a super mixer, and a microspeed mixer.

Examples are shown below to specifically describe the present invention.

The amounts of the components are shown in terms of the parts by weight unless otherwise specified.

EXAMPLE 1

A toner particle material having the following composition was prepared.

Toner particle composition

Styrene-acrylic resin: 86% by weight.

Glass transition point: 55.6° C.

150° C. melt index: 5 (g/10 min.)

Carbon black: 7.5% by weight.

Charge control agent: 1.5% by weight.

Polypropylene wax of melting point 140° C.: 3% by weight.

Polyethylene wax of melting point 99° C.: 2% by weight.

These materials were dispersed and mixed in a Henshel mixer, and the mixture was then melted and kneaded using a two-shaft screw extruder.

The kneaded mixture was cooled and then coarsely crushed using a hammer mill.

Next, the coarsely crushed mixture was pulverized using a jet mill, and a separator was used to classify the pulverized mixture, thereby obtaining toner particles.

Then, the Henshel mixer, which was heated with 45° C. hot water was used to mix 0.6% by weight. of hydrophobic silica into 100% by weight. of toner particles obtained, thereby obtaining a toner.

Figure 3:
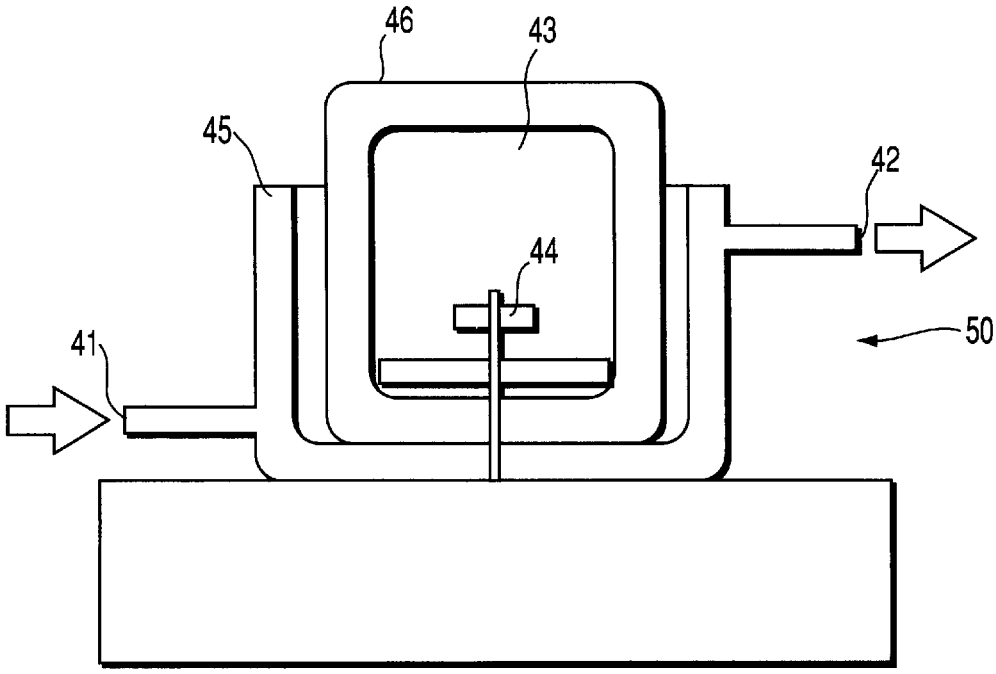
FIG. 3 is a schematic drawing showing an example of a high-speed fluidized blender for use in manufacturing a toner according to the present invention.

The available configuration of the Henshel mixer is shown in FIG. 3.

As shown in the figure, this Henshel mixer 50 comprises a mixer body 46 having an agitation chamber 43 with an agitation blade 44 provided therein. A heating hot water inlet 41 and a heating hot water outlet 42, and a heating jacket 45 covering an external surface of the mixer body 46. The Henshel mixer 50 introduces hot water at a predetermined temperature into the heating jacket 45 through the heating hot water inlet 41 and ejects the water through the heating hot water outlet 42. Accordingly, the temperature inside the agitation chamber 43 can be kept constant while an agitated material is being agitated in the agitation chamber 43 by means of the agitation blade 44.

By mixing the toner at high temperature, the toner surface can be melted to bury partially therein the additive such as silica mixed into and attach to the toner particles, thereby achieving firm adhesion. Increasing the amount of silica added and firmly attaching buoyant silica is more effective than increasing the amount of waxes to improve the fixing performance, which may result in the degraded fluidity of a developing agent or improper charging.

Then, 6% by weight. of toner obtained and 94% by weight. of manganese-magnesium-based ferrite carrier with its surface coated with silicone were mixed together and agitated for one hour using a ball mill, thereby obtaining a developing agent. The developing agent obtained was loaded in the image forming apparatus shown in FIG. 2 to form an image.

The image obtained was evaluated for its fixing characteristics in terms of the fixing rate, smears, and offsets.

To evaluate the fixing rate, a fixed image formed with the temperature of the fixing device kept constant was measured for its image density, and this image portion was rubbed using a cotton pad consisting of 100% cotton and was then subjected to an image density measurement again. The results obtained were calculated using the following equation.

Fixing rate=image density after rubbing/image density before rubbing×100(%)

For the evaluation of the fixing rate, the rate of 75% or more was indicated by ○, the rate between 70 and 75% was indicated by Δ, and the rate of 70% or less was indicated by X.

As a smear test, a test chart was used to form images on 50 sheets of A4-sized paper, and the sheets were then allowed to pass through an automatic form feed apparatus. For the evaluation, the images were monitored for smears originating in the pressure of a separation belt or friction between the belt and the sheet, and those images that fall within an allowable range were indicated by ○, while those that fall outside this range were indicated by X.

The image was visually checked for offsets with fixing temperature between 140 and 220° C. taking into account the non-uniform temperature distribution involved in the electromagnetic induction heating method. For the evaluation, offsets occurring at 180±30° C. or higher were indicated by ○, those occurring at a temperature between 180±25° C. and 180± were indicated by Δ, and those occurring at a temperature less than 180±25° C. were indicated by X.

As another check item, the storage state under hot and humid conditions was also examined. This was checked by leaving the toner at 45° C. with a relative humidity of 85% for 200 hours to monitor the toner for its blocking state. To do this, the toner that had been left in a hot and humid environment was placed on a 42 mesh, which was then set on a vibrating table of a power tester (manufactured by Hosokawa Micron Co., Ltd.), where the toner was vibrated for 10 seconds. After the vibration, a toner remaining on the mesh was measured for its weight. For the evaluation, the toner weight of 1 g or less was indicated by ○, the toner weight between 1.1 and 2 g was indicated by Δ, and the toner weight more than 2 g was indicated by X.

As a result, Example 1 exhibited a superior fixing characteristic. In addition, the toner left in the hot and humid environment created no problem; it was not subjected to blocking. The results are shown in Table 1 shown below.

EXAMPLES 2 TO 5, COMPARATIVE EXAMPLES 1 TO 5

A developing agent was obtained in the same manner as in Example 1 except for the varying glass transition point and 150° C. melt index of the styrene-acrylic resin and the varying addition amounts and melting points of the polypropylene and polyethylene waxes.

The developing agent was used to form an image, which was then evaluated for its fixing characteristic and stored state in the same manner as in Example 1. The results are shown in Table 1.

TABLE 1

| | | Glass transition point (° C.) | 150° C. CMI (g/10 min.) | Polypropylene wax Addition amount (wt %) | Polypropylene wax Melting point (° C.) | Polyethylene wax Addition amount (wt %) | Polyethylene wax Melting point (° C.) | Fixing rate | Smear | Offset | Toner blocking |
|---|---|---|---|---|---|---|---|---|---|---|---|
| Examples | 1 | 55.6 | 5 | 3 | 140 | 2 | 99 | ○ | ○ | ○ | ○ |
| | 2 | 57 | 2.3 | 6 | 140 | 1 | 99 | ○ | ○ | ○ | ○ |
| | 3 | 59.2 | 6.3 | 4 | 140 | 3 | 99 | ○ | ○ | ○ | ○ |
| | 4 | 54.7 | 7.2 | 5 | 136 | 2 | 91 | ○ | ○ | ○ | ○ |
| | 5 | 58.1 | 4.6 | 5 | 145 | 2 | 127 | Δ | ○ | ○ | ○ |
| | 6 | 58 | 1.2 | 4 | 140 | 2 | 99 | Δ | ○ | ○ | ○ |
| | 7 | 58 | 9.8 | 4 | 140 | 2 | 99 | ○ | Δ | ○ | ○ |
| | 8 | 50.2 | 5.5 | 4 | 140 | 2 | 99 | ○ | ○ | ○ | Δ |
| | 9 | 65 | 5.7 | 4 | 140 | 2 | 99 | Δ | ○ | ○ | ○ |
| Comparative Examples | 1 | 66.7 | 0.6 | 3 | 148 | 2 | 130 | x | ○ | x | ○ |
| | 2 | 49 | 11 | 3 | 133 | 2 | 89 | ○ | x | x | x |
| | 3 | 58.1 | 5.4 | 2 | 142 | 3 | 97 | ○ | ○ | x | ○ |
| | 4 | 57.3 | 5.5 | 8 | 142 | 0 | — | ○ | x | ○ | x |
| | 5 | 56.8 | 5.1 | 0 | — | 8 | 97 | ○ | x | x | x |

Examples 1 to 9 in Table 1 indicate that the toner comprising the styrene-acrylic resin having a glass transition point between 50 and 65° C. and a 150° C. melt index between 1 and 10 (g/10 min.), 3 to 6% by weight. of polypropylene wax having a melting point between 135 and 146° C., and 1 to 3% by weight. of polyethylene wax having a melting point between 90 and 128° C. has no disadvantage in terms of the fixing characteristic or the toner state in the hot and humid environment.

Comparative Example 1, however, underwent a low fixing rate and offsets at low temperature, due to the high glass transition point and small melt index of the resin. On the contrary, Comparative Example 2 was subjected to smears, offsets at low temperature, and toner blocking in the hot and humid environment. Due to the low glass transition point and large 150° C. melt index of the resin. Comparative Example 3, which had a smaller amount of polypropylene wax added, underwent only offsets at low temperature. Comparative Example 4, which was free from the polyethylene was, exhibited an inappropriate smear characteristic. In this case, with 8 pts. wt. of polypropylene wax added, the toner state in the hot and humid environment was improper. Comparative Example 5, which was free from the polypropylene wax, showed a substantially degraded offset characteristic. It was also subjected to smears and toner blocking.

What is claimed is:

1. A developing agent comprising:

a coloring agent;

a toner containing a styrene-acrylic resin having a glass transition point between 50 and 65° C. and a 150° C. melt index between 1 and 10 (g/10 min.);

a polyethylene wax in 1 to 3% by weight. of the total weight of the toner, the polyethylene wax having a melting point between 90 and 128° C.; and a polypropylene wax in 3 to 6% by weight. of the total weight of the toner, the polypropylene wax having a melting point between 135 and 146° C.

2. A developing agent according to claim 1, wherein said polyethylene and polypropylene waxes are added to the toner in 8% by weight. or less altogether of the total weight of the toner.

3. A developing agent according to claim 1, wherein said binder resin has a glass transition point between 55 and 61° C. and a 150° C. melt index between 3 and 8 (g/10 min.).

4. A developing agent according to claim 1, wherein said polyethylene wax has a melting point between 90 and 116° C. and is added to the toner in an amount between 1 and 3% by weight. of the total weight of the toner.

5. A developing agent according to claim 1, wherein said polypropylene wax has a melting point between 135 and 146° C. and is added to the toner in an amount between 4 and 6% by weight. of the total weight of the toner.

6. An image forming apparatus comprising:

an image carrier;

a developing device provided opposite to the image carrier for housing a developing agent comprising:

a coloring agent and a toner containing a styrene-acrylic resin having a glass transition point between 50 and 65° C. and a 150° C. melt index between 1 and 10 (g/10 min.), a polyethylene wax in 1 to 3% by weight. of the total weight of the toner, the polyethylene wax having a melting point between 90 and 128° C., and a polypropylene wax in 3 to 6% by weight. of the total weight of the toner, the polypropylene wax having a melting point between 135 and 146° C., and for developing an electrostatic latent image formed on the image carrier in order to form a developing agent image;

a transfer device for transferring the developing agent image onto an image receiving member; and a fixing device based on the electromagnetic induction heating method for fixing the developing agent image transferred onto the image receiving member.

7. An image forming apparatus according to claim 6, wherein said polyethylene and polypropylene waxes are added to the toner in 8% by weight. or less altogether of the total weight of the toner.

8. An image forming apparatus according to claim 6, wherein said binder resin has a glass transition point between 55 and 61° C. and a 150° C. melt index between 3 and 8 (g/10 min.).

9. An image forming apparatus according to claim 6, wherein said polyethylene wax has a melting point between 90 and 116° C. and is added to the toner in an amount between 1 and 3% by weight. of the total weight of the toner.

10. An image forming apparatus according to claim 6, wherein said polypropylene wax has a melting point between 135 and 146° C. and is added to the toner in an amount between 4 and 6% by weight. of the total weight of the toner.

11. An image forming apparatus according to claim 6, wherein said fixing device includes a heating member having a magnetized metallic surface, a pressure member, an exciting coil built into at least one of the heating and pressure members, and means connected to the exciting coil for generating high-frequency magnetic fields.

12. An image forming method comprising:

the electrostatic latent image formation step of forming an electrostatic latent image on an image carrier;

the developing step of developing the electrostatic latent image using a developing agent comprising a coloring agent and a toner containing a styrene-acrylic resin having a glass transition point between 50 and 65° C. and a 150° C. melt index between 1 and 10 (g/10 min.), a polyethylene wax in 1 to 3% by weight. of the total weight of the toner, the polyethylene wax having a melting point between 90 and 128° C., and a polypropylene wax in 3 to 6% by weight. of the total weight of the toner, the polypropylene wax having a melting point between 135 and 146° C.;

the transfer step of transferring the developed developing agent image onto an image receiving member; and the fixing step of fixing the developing agent image transferred onto the image receiving member, by heating the image based on the electromagnetic induction heating method while pressurizing the image.

13. An image forming method according to claim 12, wherein said polyethylene and polypropylene waxes are added to the toner in 8% by weight. or less altogether of the total weight of the toner.

14. An image forming method according to claim 12, wherein said binder resin has a glass transition point between 55 and 61° C. and a 150° C. melt index between 3 and 8 (g/10 min.).

15. An image forming method according to claim 12, wherein said polyethylene wax has a melting point between 90 and 116° C. and is added to the toner in an amount between 1 and 3% by weight. of the total weight of the toner.

16. An image forming method according to claim 12, wherein said polypropylene wax has a melting point between 135 and 146° C. and is added to the toner in an amount between 4 and 6% by weight. of the total weight of the toner.

17. An image forming method according to claim 12, wherein said fixing device includes a heating member having a magnetized metallic surface, a pressure member, an exciting coil built into at least one of the heating and pressure members, and means connected to the exciting coil for generating high-frequency magnetic fields.

* * * * *